US012264551B2

(12) United States Patent
Louden et al.

(10) Patent No.: US 12,264,551 B2
(45) Date of Patent: Apr. 1, 2025

(54) DOWNHOLE APPARATUS AND METHOD COMPRISING COMPACTED THERMITE

(71) Applicant: ISOL8 (HOLDINGS) LIMITED, Aberdeen (GB)

(72) Inventors: Andrew Louden, Aberdeen (GB); William Edward Lowry, Port Townsend, WA (US)

(73) Assignee: ISOL8 (HOLDINGS) LIMITED, Aberdeen (GB)

( * ) Notice: Subject to any disclaimer, the term of this patent is extended or adjusted under 35 U.S.C. 154(b) by 0 days.

(21) Appl. No.: 18/035,165

(22) PCT Filed: Nov. 4, 2021

(86) PCT No.: PCT/EP2021/025428
§ 371 (c)(1),
(2) Date: May 3, 2023

(87) PCT Pub. No.: WO2022/096149
PCT Pub. Date: May 12, 2022

(65) Prior Publication Data

US 2024/0011367 A1 Jan. 11, 2024

(30) Foreign Application Priority Data

Nov. 4, 2020 (GB) ..... 2017444

(51) Int. Cl.
*E21B 33/134* (2006.01)
*E21B 33/12* (2006.01)
*E21B 36/00* (2006.01)

(52) U.S. Cl.
CPC ..... *E21B 33/134* (2013.01); *E21B 33/12* (2013.01); *E21B 36/008* (2013.01)

(58) Field of Classification Search
CPC ..... E21B 33/134; E21B 33/12; E21B 36/008
See application file for complete search history.

(56) References Cited

U.S. PATENT DOCUMENTS 3,208,530 A 9/1965 Allen et al.
5,833,001 A * 11/1998 Song ..... E21B 29/10 166/57

(Continued)

FOREIGN PATENT DOCUMENTS

EP 3241982 B1 12/2019
GB 2586796 A 3/2021

(Continued)

OTHER PUBLICATIONS

International Search Report and Written Opinion for Int. App. No. PCT/EP2021/025428, mailed Mar. 14, 2022.

*Primary Examiner* — Shane Bomar
(74) *Attorney, Agent, or Firm* — MCDONNELL BOEHNEN HULBERT & BERGHOFF LLP

(57) ABSTRACT

A downhole tool comprises a heater including a container enclosing a volume of compacted thermite. A volume of flowable alloy is provided above the heater. A fusible bulkhead may be provided between the heater and the alloy and provides for direct conduction of heat from the heater to the alloy. A housing containing the alloy may be separated from the heater by heating a fusible socket that anchors an end of a tensioned support member. The thermite may define an internal volume adapted to receive alloy. The heater may be activated to melt the alloy and the alloy may then solidify to form a bore-sealing plug.

19 Claims, 3 Drawing Sheets

(56) References Cited

U.S. PATENT DOCUMENTS

| | | | | |
|---|---|---|---|---|
| 7,640,945 | B2 | 1/2010 | Lin | |
| 2006/0037748 | A1* | 2/2006 | Wardlaw | E21B 36/008 166/387 |
| 2006/0144591 | A1 | 7/2006 | Gonzalez et al. | |
| 2015/0211322 | A1* | 7/2015 | Lowry | E21B 36/008 166/57 |
| 2018/0085850 | A1* | 3/2018 | Huang | E21B 17/00 |
| 2018/0094504 | A1* | 4/2018 | Hearn | E21B 33/13 |
| 2019/0085659 | A1 | 3/2019 | Carragher et al. | |
| 2020/0208494 | A1* | 7/2020 | Lowry | E21B 43/082 |
| 2022/0090463 | A1* | 3/2022 | Louden | E21B 33/134 |
| 2022/0205342 | A1* | 6/2022 | Louden | E21B 43/105 |
| 2022/0403711 | A1* | 12/2022 | Louden | E21B 36/00 |
| 2023/0258052 | A1* | 8/2023 | Tøndel | E21B 29/02 166/285 |

FOREIGN PATENT DOCUMENTS

| | | | |
|---|---|---|---|
| WO | 2020/142414 | A1 | 7/2020 |
| WO | 2020/144091 | A2 | 7/2020 |
| WO | 2020/216475 | A1 | 10/2020 |
| WO | 2021/043444 | A1 | 3/2021 |

* cited by examiner

DOWNHOLE APPARATUS AND METHOD COMPRISING COMPACTED THERMITE

CROSS REFERENCE TO RELATED APPLICATIONS

The present application is a U.S. National Phase application pursuant to 35 U.S.C. § 371 of International Application No. PCT/EP2021/025428 filed Nov. 4, 2021, which claims priority to GB Patent Application No. 2017444.7 filed Nov. 4, 2020. The entire disclosure contents of these applications are herewith incorporated by reference into the present application.

FIELD

This disclosure relates to a downhole apparatus and a downhole method. The disclosure describes an apparatus for use in forming a seal or plug in a bore, such as a bore used to access a subsurface hydrocarbon-bearing formation.

BACKGROUND

There are numerous situations in which an operator may wish to seal or plug a bore hole, for example when an oil and gas well is being abandoned. There have been numerous proposals for sealing bore holes using low melt point alloy in combination with a thermite heater.

U.S. Pat. No. 3,208,530 describes apparatus for setting alloy bridge plugs as an improvement to cement dump bailers. The apparatus includes an elongated heater, an elongated volume of alloy, and a basket assembly. The alloy is initially provided within an insulated bailer. In one embodiment the heater has an axial or in-line form and includes an upper unit and a lower unit of larger diameter, below the insulated bailer. A cylindrical sleeve is provided around the lower heater unit and provides mounting for the basket assembly. Upon activation of the heater, the alloy melts, flows into the basket and gathers around the sleeve containing the large diameter heater unit. The alloy then solidifies to form an impermeable cylindrical plug. The heater may then be retrieved from the sleeve, leaving a cylindrical plug body. The heater may be an electrical heater or an elongated heating element containing a mixture of aluminum dust and iron oxide.

U.S. Pat. No. 7,640,965 describes a well abandonment plug. An alloy, such as a Bismuth alloy, may be delivered into a well in pellet form using coiled tubing or a dump bailer. In one embodiment a liquid column of molten Bismuth-alloy is created on top of a conventional mechanical or cement plug within a casing string. As the melting point of the alloy selected is greater than the equilibrium well temperature at that depth the liquid alloy will solidify within the casing and form a gas-tight seal separating the lower section of the casing from the portion above.

US2006144591A1 describes a repair tool including a housing comprising a chamber filled with eutectic metal in the form of pellets and a chamber filled with an exothermic reactant material. The housing includes release ports filled with release plugs which release when sufficient pressure and heat are produced by igniting the exothermic reactant material and melting the eutectic pellets.

EP3241982A1 describes plug deployment apparatus for use in the plugging of underground wells. A plug deployment assembly comprises a plug body, a thermite heater and a dump bailer containing eutectic alloy. The plug body is provided with an umbrella spring arrangement which is mounted to the leading end of the plug. The alloy may be initially provided in the form of shot. The alloy shot is ejected from the dump bailer into the region adjacent to the plug body containing the heater. The expanded umbrella spring arrangement contacts the side walls of the underground conduit so that the alloy shot does not fall past the plug. Once the alloy shot has collected adjacent the plug/heater, the heater can be actuated to melt the alloy and form a molten alloy. The molten alloy is then allowed to cool whereupon it expands to secure the plug body relative to the underground conduit. Once the alloy has cooled the heater can be extracted from the plug body.

Applicant's WO2020/144091, the entire disclosure of which is incorporated herein by reference, describes a method of sealing a subsurface bore comprising: locating a volume of thermite in the bore; locating a volume of alloy in the bore; initiating reaction of the volume of thermite to heat the volume of alloy; and bringing the volume of alloy to above the melting point of the alloy whereby the alloy flows and thermite reaction products and the alloy combine to provide a bore-sealing plug.

SUMMARY

The present disclosure relates to a method of manufacturing a heater comprising filling a container with thermite, compressing the thermite in the container, and enclosing the compressed thermite within the container.

Another aspect of the disclosure relates to a heater comprising a container enclosing a volume of compressed thermite.

The heater may be for use in a downhole environment such as a bore for an oil or gas well and may be incorporated in a downhole sealing tool. Accordingly, the heater may have an elongate form to facilitate translation of the heater from surface to a downhole location.

The heater may include an initiator to start the thermite reaction. The initiator may be provided at a lower end of the heater, at the upper end of the heater, or intermediate the ends of the heater. One or more initiators may be provided.

A wall of the container may be supported as the thermite is compressed in the container, for example the container may be located within a die.

The compression or compaction of the thermite, and the optional compression/compaction of the thermite within an externally supported container, may provide various advantages. The porosity of the thermite may be reduced relative to a non-compressed thermite, providing a denser thermite volume, facilitating the reaction of the thermite and the generation of greater heat. For example, compacting powdered or granular thermite may reduce its volume by more than a factor of two, reducing its porosity from more than 50% to 35% or less, and increasing its density proportionally to a specific gravity of 2.7 to 3.3 or more depending on its composition. The density may thus be increased by 50%, or may be increased by a smaller degree, for example by 10%, 20%, 30% or 40%, and the porosity reduced by 30% or more, or by a smaller degree, for example by 10%, 15%, 20% or 25%. The compressed thermite may retain its form within the container and thus may be provided without requiring the presence of binding agents, which may adversely impact the thermite reaction. The thermite may be compressed to eliminate any air gap between the thermite and the container wall, facilitating heat transfer to the container and to material external of the container. The compressed thermite will have significant compressive strength and may be resistant to further compression by the well pressure, and a sealed container may be located in a high-pressure environment without experiencing significant deformation. If supported during the compression of the thermite, the container may have a relatively thin wall, even an ultra-thin wall, reducing the heat energy that is absorbed by the container and facilitating heat transfer through the container wall. The provision of a thin wall also increases the volume of thermite that may be provided for a given container diameter and facilitates placing the thermite in closer proximity to surrounding structures, such as casing, which are to be heated. The structural strength provided by the compressed thermite also allows use of low strength housing material, such as an aluminium alloy, which may melt at lower temperature than steel, to allow the thermite reaction products to flow if they take on a fluid form.

In other aspects of the disclosure powdered or granular thermite may be compacted without the provision of an external container, or an external container may be provided but then removed, the compacted material being self-supporting and having sufficient strength to be incorporated in apparatus without requiring external containment. The thermite may then be wrapped, coated, or placed within an external skin, coating, or container to prevent ingress of water or other liquid. Preferably, the wrapping or coating is applied to minimise or avoid any air gap between the thermite and the containing material, thus improving heat transfer from the thermite through the container and to an adjacent or surrounding material or structure.

The thermite may be a unitary, continuous volume. The uncompressed thermite may be placed in the container in a single operation and then subject to compression. Alternatively, a first fraction of the volume of thermite may be placed in the container and then subject to compression. A second fraction of the volume of thermite may be placed in the container, on top of the first volume, and then subject to compression, and this process may be repeated until the container has been filled.

The thermite may be of any appropriate composition of metal and metallic or non-metallic oxide which will react exothermically to form a more stable oxide and the corresponding metal or non-metal of the reactant oxide. For example, the thermite may comprise a mix of iron oxide and aluminium. If heated to an appropriate initiation temperature, for example 800-1300° C., the iron oxide/aluminium thermite may react exothermally and generate temperatures of up to, for example, 2900° C. The thermite may include additives which lower the peak reaction temperature, if desired, or the solidification temperature of the thermite reaction products.

The composition of the thermite may be selected to provide an appropriate selection of characteristics, for example the reaction temperature of the thermite may be controlled by the addition of various additives. The mobility of the reacting thermite may also be controlled, for example the provision of certain additives will facilitate the thermite retaining its original form as the thermite reacts and will prevent or limit the separation of molten thermite reaction products. For example, the fluidity of the thermite may be adjusted by dilution of the reactive thermite components with a high solidification temperature additive, which will tend to provide a "stiffer" thermite which is more likely to retain an initial form and flow very little or not at all. An undiluted thermite mix will react and flow quickly to solidify at a high temperature, whereas a mix diluted with a low solidification temperature additive is more likely to form reaction products which continue to flow at lower temperatures before solidifying. In other examples it may be desirable for the molten thermite reaction products to flow into or through perforations of gaps in surrounding structures. For example, the mobility of the thermite may be increased by providing an additive in the volume of thermite, whereby the metal and the metallic or non-metallic oxide of the thermite react exothermically to form a metal oxide and the corresponding metal or non-metal of the reactant oxide, and whereby the metal oxide reacts with the additive to form a low solidification temperature reaction product having a solidification temperature lower than the solidification temperature of the pure metal oxide. The low solidification temperature reaction product may flow until the temperature of the reaction product decreases to the liquidus temperature of the product, at which point it no longer flows and becomes a solid, and thus such a modified thermite is likely to be able to remain mobile for longer than the higher solidification temperature metal oxide. Thermite compositions having different compositions and different properties are described in greater detail in applicant's WO2020/144091.

The composition of the thermite may be consistent throughout the volume or may vary. For example, a portion of the thermite may have a composition selected to provide a high reaction temperature or to provide a high temperature, mobile reaction product. Such a high temperature volume may be used, for example, to cut or melt through an adjacent material or object.

The container may be formed of any suitable material, preferably a highly heat-conducting material such as a metal. The container may be intended to substantially retain its form during reaction of the thermite and may be formed of a material such as steel. Alternatively, the container may comprise a fusible or combustible material which will degrade or melt during reaction of the thermite and may be formed from an aluminium alloy.

The container may take any appropriate shape or form. The container may be cylindrical or may be annular.

The thermite may be isolated from surrounding fluid, for example well fluid, facilitating ignition of the thermite. The container may be sealed. The interior of the container may be at atmospheric pressure or may be pressure balanced.

The heater may be provided in combination with a volume of alloy. The alloy may be located above the heater or may surround or be located below the heater. The alloy may be provided in any appropriate form, for example in flowable shot, beads, or pellets, or as a unitary or multi-part solid mass. The alloy may be formed about the heater in solid or bead form. The volume of alloy may be melted by the heater to flow and occupy a selected volume. As the heater cools, the alloy will solidify. The alloy may solidify to form a continuous solid barrier to, for example, seal a bore. The solid plug may form above the heater. In other examples the heater may be retrieved from the bore. The alloy may solidify to create an annular barrier or plug, allowing access to the bore below the plug.

The alloy may be of any appropriate composition and provided in any appropriate form. The alloy may have a lower melting point than at least one thermite reaction product. The alloy may be a low melt point alloy, for example a bismuth-based alloy such as a Bismuth Tin (Bi/Sn) alloy and may be a eutectic alloy. The metal may be a 58/42 Bismuth Tin (Bi/Sn) alloy, which melts/freezes at 138° C. Alternatively, the alloy may have a higher melting temperature, and may be a Babbitt alloy. One such alloy may be a high tin alloy using copper, antimony, or other metal additives to achieve desired melt ranges and physical properties; the alloy may comprise 2.5-8.5% copper, 4-16% antimony, <1% nickel. The alloy may be eutectic. The alloy may include fillers that affect one or more properties of the alloy, such as the mobility of the molten alloy, the ability of the alloy to transfer heat, or the creep resistance of the alloy. In other examples a single or pure metal may be provided rather than an alloy, or a volume of metal may be provided in combination with a volume of alloy. In the interest of brevity, reference is made primarily herein to "alloy", but the skilled person will understand that the references to alloy may apply equally to a metal.

The alloy may be in direct contact with the thermite or may be in contact with the thermite via a conductive barrier, such as the wall of the thermite container or a metal bulkhead, to facilitate transfer of heat from the thermite to the alloy. Where a bulkhead is provided, the bulkhead may comprise a fusible material, and the bulkhead may be configured to degrade or melt at a predetermined temperature. The melt temperature of the bulkhead may be higher than the melt temperature of the alloy. In one example the bulkhead comprises a Babbitt alloy, having a melt temperature of 240° C.

The alloy may be provided in any appropriate form, for example as a cast sleeve or cartridge, or in a loose, flowable, or particulate form, such as tablets, pellets, beads, or powder.

The alloy may be initially retained within a carrier or housing. The alloy may be retained in the housing until the thermite has been ignited and may be retained in the housing for a predetermined period after the thermite has been ignited, or until the thermite has reached a predetermined temperature. A predetermined proportion of the alloy may be melted before being released from the retainer.

The alloy may be provided in layers or portions of different composition, with tailored metallurgical properties, to perform specific roles at different regions in the final solidified mass.

If the thermite includes a portion that reacts to form mobile iron and aluminium oxide, or other mobile reaction products, it may be desirable to allow the thermite reaction products to solidify or freeze before molten alloy is permitted to contact the thermite reaction products; the alloy will likely have a greater density than the thermite reaction products and may displace the reaction products. As the aluminium oxide freezes to form a porous solid, the ability to form a seal in a bore may be compromised. For example, if an attempt is being made to seal an inclined bore, mixing the molten alloy with molten thermite reaction products may result in a layer of aluminium oxide "floating" on top of the alloy and freezing to create a leak path through the plug. Alternatively, the thermite may be retained within a container or otherwise prevented from mixing with the molten alloy.

Flux may be provided to enhance bonding between the alloy and, for example, a surrounding bore-lining tubing. The flux may be provided within or in combination with the volume of alloy or may be provided in a liquid to be circulated into the bore. Examples of flux materials and flux delivery methods are described in WO2020/144091, WO2020/216475, GB2586796 and WO2021/043444, the disclosures of which are incorporated herein in their entirety. In one example the flux is provided in powder, tablet, bead, or pellet form and is mixed with alloy beads before the alloy and flux is placed in a carrier.

The alloy may be sealed within a carrier such that the alloy, and any flux that is present, remains dry as the alloy is run into a fluid-filled bore. This facilitates melting of the alloy by the heater, as any liquid in the container, particularly water, absorbs a significant amount of heat energy and can slow or limit melting of the alloy. Also, this facilitates and permits use of fluxes which react with or degrade in the presence of water, as the flux is maintained in a dry condition until the alloy and the flux are released from the carrier.

The thermite may define an internal passage or volume. The internal volume may contain alloy or may be arranged to receive a volume of alloy. Alloy within the internal volume will be subject to an elevated degree of heating and will create a heat plume which is effective in transferring heat from the thermite to alloy above the thermite. The alloy may be permitted to flow into the internal volume before being released into an external volume.

A wall defining the internal passage or volume may be supported while the thermite is compacted in the container. Alternatively, the internal passage wall may have sufficient strength to support the surrounding thermite while the thermite is being compressed. The passage may extend axially of the thermite and be centrally located within the thermite.

An internal conduit may be provided in the thermite, and the conduit may be defined by one or more pipes or tubes, and the conduit may define the internal passage or volume. The conduit may extend axially of the thermite and may be located centrally of the thermite. The conduit may comprise or provide a passage for elongate members such as supporting cable or wires, communication, control, or power lines. The tube may comprise a material which retains its integrity following the ignition of the thermite, such as steel, or may comprise a material which melts or degrades as the thermite reacts, such as an aluminium alloy. Elongate members within the tube may be retrieved following ignition of the thermite or may remain in the tube. Alloy may be located in the conduit, or the conduit may be arranged to receive a volume of alloy following the initiation of the thermite reaction. In one example, the conduit initially contains a control line which is removed from the conduit following ignition of the thermite and following removal of the control line alloy is permitted to flow into the conduit.

The heater may be provided in combination with a retainer for supporting the heater in a bore. The retainer may be positioned below the heater. The retainer may include extendable grips or slips which are initially retained in a retracted configuration to facilitate passage of the heater through a bore. The grips may be extended on activation of the heater. For example, the grips may be biased to an extended, gripping configuration and are released on a retaining arrangement being heated by the reacting thermite. The retainer may include an occluding member, such as a sealing disc, which is extendable to prevent or limit passage of molten alloy. The occluding member may be biased towards an extended, occluding configuration and is released on a retaining arrangement being heated by the reacting thermite.

The heater and retainer may be run into the bore simultaneously, and may be initially coupled or connected, or supported on a common support member. The retainer may be uncoupled from the support member, or from the heater, on activation of the heater.

Elements of the heater, or a tool incorporating the tool, may be maintained under tension, and the elements may be retained together by tension. A tension member may extend through the elements. For example, the thermite container and an alloy housing may be held together under tension, and when the tension is released, for example by severing a tension member, the container and the housing may move apart, or may be moved apart, allowing alloy to flow out of the lower end of the housing. A tubular or telescopic member may be provided to extend between the alloy housing and the thermite container to retain the alloy when the housing is separated from the container. The use of tension may permit tool elements to be stacked and coupled without the requirement to provide threaded connections between the elements.

Another aspect of the disclosure relates to a thermite heater comprising a volume of thermite defining an internal volume for receiving alloy to be heated.

A further aspect of the disclosure relates to downhole apparatus comprising a thermite heater including a container, a volume of thermite within the container, a volume of alloy, and a fusible bulkhead located between the thermite and the alloy and in contact with the thermite and the alloy.

An alternative aspect of the disclosure relates to downhole apparatus including a carrier containing a volume of alloy intermixed with a volume of flux, wherein the carrier is sealed to maintain the alloy and flux in a dry condition.

The disclosure also relates to a downhole method comprising providing a volume of alloy intermixed with a volume of flux to a downhole location and delivering the alloy and the flux to a downhole location while isolating the alloy and the flux from downhole fluid.

The alloy and flux may be provided in any appropriate form, for example as powder, pellets, beads, or tablets.

The alloy and flux may be provided within one or more suitable carriers or containers, which may be rigid and provide a structural element of a downhole tool, or may be flexible, such as one or more bags.

The alloy and the flux may be released and flow to an appropriate location, for example to a sealing location, once a heater has been activated. The alloy and flux may be released after at least a portion of the alloy has been melted.

In other aspects the flux may be sealed within the alloy, for example the alloy may be a cast volume with the flux provided within the volume such that the flux is isolated from downhole fluid until the alloy is melted.

These and other aspects of the disclosure may have utility in well plugging for abandonment, and to isolate a hydrocarbon reservoir and any intermediate or shallower formation zones. Aspects of the disclosure may be useful in well intervention at other stages during the life cycle of a well.

The skilled person will appreciate that the different aspects of the disclosure described herein may be combined or may be provided individually, and the various features of the different aspects described above, and as recited in the attached claims, may be combined with other aspects and other claims, and may have individual utility, separately of the various aspects of the disclosure.

BRIEF DESCRIPTION OF THE DRAWINGS

These, and other aspects of the disclosure will now be described, by way of example, with reference to the accompanying drawings, in which.

DETAILED DESCRIPTION

Figure 1:
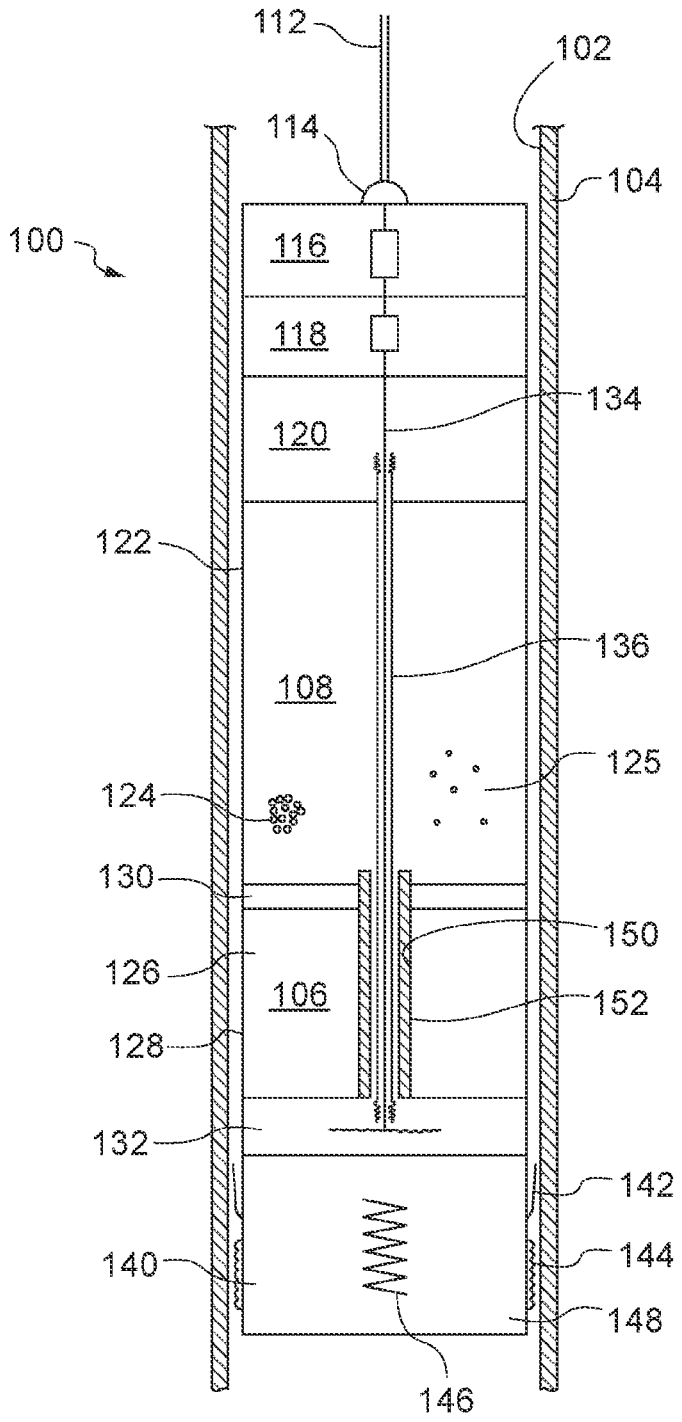
FIG. 1 is a schematic of a downhole sealing tool according to a first example of the disclosure.

Referring first to FIG. 1 of the drawings, there is illustrated a downhole sealing tool 100 according to a first example of the disclosure. The tool 100 is intended to be run into a bore 102, such as a well bore used to access a subsurface hydrocarbon-bearing formation and activated to seal the bore at a sealing zone at a predetermined depth in the bore. The bore may be defined by steel tubing 104, such as casing or liner. The tool 100 may be utilised to form a seal in a bore such as when the well is being abandoned and it is desired to permanently plug the bore. The seal may form or extend beyond the steel tubing 104, for example if the tubing is perforated or if the tubing incorporates a sand screen or the like. In other examples the tool may be configured to leave through bore access below the plug.

As will be described, the tool 100 operates by activating a thermite heater 106 to melt a volume of alloy 108, the molten alloy flowing to fully occupy a section of the bore above the heater 106 and then solidifying or freezing to form an impermeable alloy plug 110 (FIG. 3) which may be bonded to the bore wall. The tool 100 will first be described in general terms, followed by more detailed descriptions of the components of the tool 100.

It should be noted that a tool made in accordance with the disclosure will typically have a length that is many times the diameter of the tool, for example a 3½ inch (8.9 cm) diameter tool may be 300 to 600 inches (762 to 1525 cm) long. However, to facilitate illustration and description, the illustrated tool 100 is shown axially compressed and the actual tool would typically be significantly longer than as illustrated in the Figures.

The tool 100 is elongate and generally cylindrical and is run into the bore 102 on a suitable support member, typically electric wireline 112. Accordingly, an upper end of the tool 100 includes a wireline coupling 114. Immediately below the coupling 114 is a power control module 116 which supplies the power used to initiate the thermite heater 106. A pressure/temperature sensitive switch module 118 is provided below the power control module 116 and is utilised to avoid premature initiation of the thermite heater 106. A tension module 120 is provided below the switch module 118.

The volume of alloy 108 is provided in the form of a tubular housing 122 filled with alloy beads 124. Powdered flux 125 is intermixed with the beads 124. The alloy 108 is positioned directly above the thermite heater 106, which takes the form of a compressed column of thermite 126 contained within a thin-walled container 128. The alloy 108 is separated from the thermite 126 by a fusible bulkhead 130. A thermite initiator 132 is provided at the lower end of the heater 106. A power supply cable 134 connects the power control module 116, through the switch module 118 to the thermite initiator 132. A lower section of the cable 134 is located within a tubular control line 136 which extends from the tension module 120 and the initiator 132. The control line 136 is maintained in tension and maintains the alloy carrier 122 and the thermite container 128 in secure fluid-tight engagement.

Below the thermite initiator 132, and forming the lower end of the tool 100, is a retainer 140 which, when the thermite heater 106 is initiated, is activated such that slips 144 grip and retainer petal disc 142 contact the inner wall of the tubing 104 and prevent molten alloy from leaking away from the sealing zone.

Figure 2:
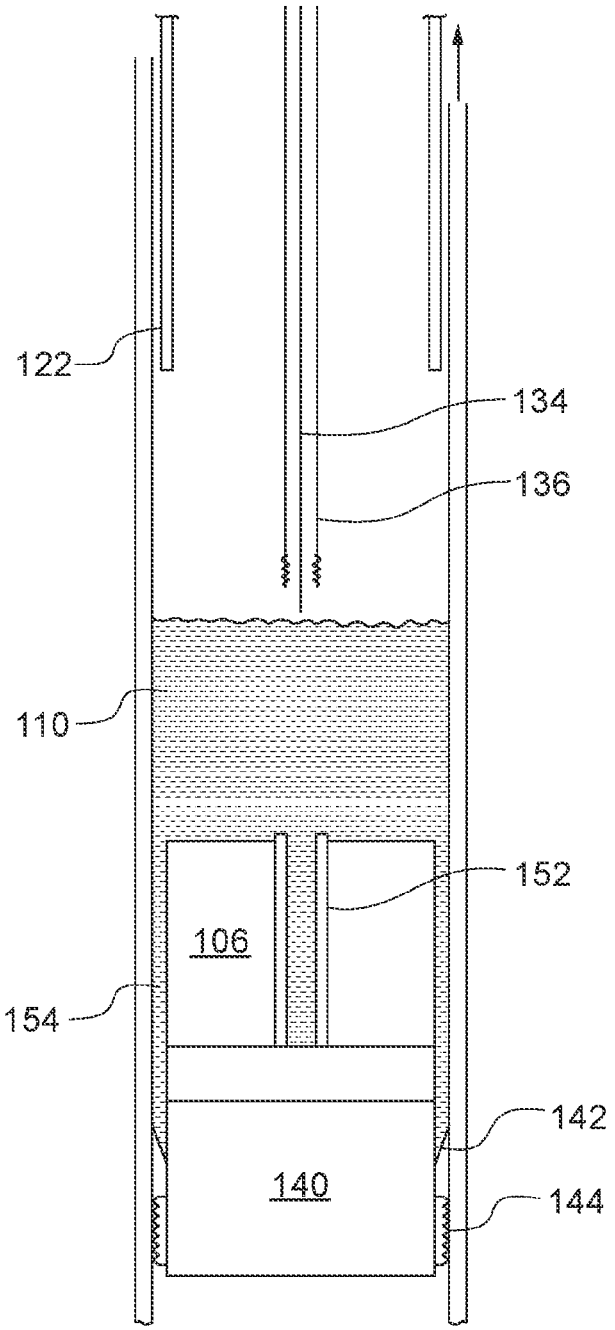
FIG. 2 shows the tool of FIG. 1 following the activation of a thermite heater incorporated in the tool.

FIG. 1 illustrates the tool 100 in an initial configuration, for running into the bore. The tool 100 will have an outer diameter that is slightly smaller than the inner diameter of the tubing 104, for example a tool 100 having an outer diameter of 3.5 inches (8.9 cm) may be used to create a plug in tubing 104 having an internal diameter of 3.55 to 8.5 inches (9.02 to 21.59 cm). The tool 100 is run into the bore with the retainer 140 in a first configuration, with an alloy retaining disc 142 and bore wall grips/slips 144 retracted. FIG. 2 illustrates the retainer 140 in an activated configuration, with the retainer petal disc 142 and the slips 144 radially extended.

The retainer 140 incorporates an energy storing arrangement, such as an axially extending coil spring 146 which is initially compressed to provide the stored energy to activate the retainer 140 and extend the disc 142 and the slips 144. The spring 146 is retained in the compressed configuration by an arrangement including a fusible member, such as an alloy shear pin.

Activation of thermite initiator 132 (discussed in greater detail below), generates elevated temperatures and weakens the alloy shear pin so that the pin fails under load, allowing the spring 146 to extend and release the retainer petal disc 142 from a disc retainer, such that the disc 142 is free to extend and engage the surrounding tubing 104. However, the disc 142 is prevented from fully extending by contact with the tubing 104 and is restrained to extend at an acute angle from the retainer body 148, forming a cup-like shape. Similarly, arms providing mounting for the slips 144 are pivoted outwards to engage the slips 144 with the tubing 104.

The initiator 132 may include a plurality of individual initiator modules which each comprise a thermite starter mix and a heating element connected to the power supply cable 134.

As noted above, the control line 136 containing the power supply cable 134 is tensioned and pulls the alloy housing 132 and thermite container 128 together to form a rigid structure, as well as supporting the alloy 108, the thermite heater 106, the initiator 132 and the retainer 140. The lower end of the control line 136 is secured by a fusible socket in the initiator 132, while the upper end of the control line 136 is engaged with a turnbuckle provided in the tension module 120.

The thermite 126 has a generally annular form and defines a central axially extending bore 150 which is lined by a rigid tube 152. The control line 136 containing the power supply cable 134 extends through the tube 152.

When power is supplied to the initiator 132 the heating elements rise to a temperature sufficient to initiate the thermite reaction in the thermite starter mix. The thermite reaction generates further heat and initiates the thermite reaction in the lowermost part of the thermite 126, which reaction then heats and initiates the thermite reaction in the upper part of the thermite 126. It should be noted that the initiator 132 and the thermite 126 are sealed within the heater 106 and are isolated from the surrounding well fluid, such that the thermite 126 remains dry and is readily ignitable.

As noted above, the initial thermite reaction activates the retainer 140. The retainer petal disc 142 extends from the retainer 140 to engage with the tubing 104 and the slips 144 also extend to grip the tubing 104. As the thermite reaction moves upwards, the temperature of the thermite 126 increases and the well fluid surrounding the heater 106, and the surrounding tubing 104, also rise in temperature. As noted above, the thermite 126 has been compressed, in one example by an applied pressure of 10,000 psi (68.9 MPa), and thus is relatively dense and with reduced porosity compared to a conventional thermite heater. As will be described in greater detail below with reference to FIG. 3 of the drawings, the compression of the thermite 126 is achieved by an axially movable piston acting on an upper surface of a volume of thermite mix which has been placed in a die-supported thin-walled container 128. Thus, as well as compacting the thermite 126 the piston also forces the thermite 126 into intimate contact with the inner surface of the container 128, and the outer surface of the central tube 152. Accordingly, there is no air gap between the outer surface of the thermite 126 and the inner surface of the container 128. Further, in use the outer surface of the container 128 is in direct contact with the well fluid. The use of a die to support the container 128 allows the container 128 to be formed of a relatively thin or weak material, which further facilitates heat transfer from the thermite 126. The weak material may be selected for properties other than structural strength, for example high heat conductivity.

The heat from the reacting thermite 126 is also conducted to the alloy 108, via the bulkhead 130, which is in direct contact with the thermite 126 on its lower face and is in direct contact with the alloy 108 on its upper face. The heat transferred via the bulkhead 130 melts the alloy beads 124 in contact with the bulkhead 130 and creates a melt pool of molten alloy above the bulkhead 130. The melt pool ensures that any well fluid is displaced out of the alloy and is effective at conducting heat, such that the remaining alloy beads 124 will settle into the molten alloy and fluidise, such that the volume of molten alloy increases rapidly.

The composition of the bulkhead 130 is selected such that the bulkhead 130 will fluidise at a predetermined interval after initiation of the thermite reaction. Once the bulkhead 130 fluidises, molten alloy will displace the fluidised bulkhead material, and come into direct contact with the reacting thermite 126. In addition, molten alloy will flow into the tube 152 which extends down through the thermite 126. The core of the thermite 126 will be at a very high temperature and in direct contact with the tube 152, such that the molten alloy flowing into the tube 152 will be heated to an elevated temperature. A heat plume thus rises from the thermite 126 to further heat the alloy 108 that remains above the heater 106.

The switch module 118 includes pressure and temperature switches which prevent inadvertent activation of the thermite initiator 132 by remaining open until the tool 100 experiences the pressure and temperature that are expected at the sealing location depth. The signal to activate the thermite reaction is relayed from surface through the electric wireline 112 but requires that the pressure and temperature switches are closed; an erroneous signal generated while the tool 100 is close to surface or only part-way to the sealing location will not activate the initiator 132.

The power control module 116 contains an appropriate number of power cells, sufficient to fire the thermite initiator 132.

Thus, in use, the tool 100 will be employed by an operator wishing to seal a well bore. The dimensions of the tool 100, and the volumes of alloy 108 and thermite 126 incorporated in the tool 100, will be selected to match the dimensions of the tubing 104 to be sealed and the differential pressure the resulting plug will be expected to withstand. The constituents of the alloy 108 and thermite 126 will also be selected based on the based on various criteria, as discussed in greater detail below.

The operator will identify the preferred sealing location in the bore 102 and will then set the pressure and temperature switches in the switch module 118, so that the switches will be set to close only when sensors associated with the switches detect the hydrostatic pressure and downhole temperatures associated with the sealing location. In other examples the switch module 118 or the power control module 116 may include a timer. The timer may introduce a predetermined delay in the initiating of the thermite reaction as further level of protection against premature initiation. The power control module 116 may further include a measurement device that can be programmed to only provide power when certain movements of tool 100 are recognised by the power control module 116.

The tool 100 is made up and run into the bore 102, supported by electric wireline 112, to the sealing location. The tubing 104 at the sealing location may have been subject to scraping or cleaning beforehand, facilitating creation of a secure and fluid-tight bond between the solidified alloy and the tubing 104. On reaching the sealing location an initiation signal is transmitted from surface through the supporting electric wireline 112. If the pressure and temperature switches in the switch module 118 are closed, confirming that the tool 100 is at the correct depth in the bore 102, then the power control module 116 is electrically connected to the thermite initiator 132, via the power supply cable 134.

The supply of power to the initiator modules causes the associated heating elements to bring the surrounding thermite, comprising a specially formulated starter mix, to a temperature sufficient to initiate a thermite reaction. The higher temperatures created by the reacting thermite result in the thermite reaction advancing upwards through the initiator 132 and into the larger bulk of the compacted thermite 126. Very soon after the thermite initiator 132 has been activated, the rising temperature within the initiator 132 will weaken the retainer alloy shear pin allowing the spring 146 to extend, removing the restraint from the retainer petal disc 142, such that the disc 142 springs out to engage the tubing 104. Similarly, the slips 144 are extended radially outwards to engage the tubing 104. The retainer 140 is now in full radial contact with the tubing 104 and is securely engaged with the tubing 104.

The tension module 120 is coupled to the upper end of the alloy housing 122 and the upper end of the tension module 120 is secured to the lower end of the switch module 118. As the temperature of the reacting thermite rises, the power supply cable 134 will melt and the fusible connection securing the lower end of the control line 136 will fail and release the control line 136 from the initiator 132. This will reduce the load being supported by the wireline 112, which reduction will be apparent to the operators working at the surface. Thereafter, the operators may then raise the wireline 112, which will also raise the power control module 116, the switch module 118, the tension module 120 and the alloy housing 122, which may be retrieved to surface. The operators may choose to raise the wireline 112 immediately the release of the control line is detected or may delay raising the wireline 112 to allow the alloy 108 to be heated to a predetermined degree before the housing 122 is separated from the container 128. As the lower end of the alloy housing 122 is lifted clear of the heater 106 the alloy 108 may flow out of the housing 122, as illustrated in FIG. 2 of the drawings.

The interior of the housing 122 is initially at atmospheric pressure, that is the alloy beads 124 and the powdered flux 125 are kept dry and isolated from the fluid in the bore 102. Accordingly, the external ambient pressure in the bore 102 will tend to push the container 128 and the housing 122 together. To facilitate separation of the housing 122 from the container 128, a pressure relief arrangement is provided in the tension module 120, and when the tension in the control line 136 is released a pressure communication passage is opened to allow the pressure within the housing 122 to equalise with the well pressure.

The alloy housing 122 may remain coupled with the heater 106 until a proportion of the alloy 106 within the housing 122 has melted. Alternatively, the alloy housing 122 may be separated from the heater 106 before any the alloy 108 has melted. In any event, the alloy beads 124, molten alloy, or a mix of melted and solid alloy will flow out of the housing 122. Some of the alloy 108 will flow into the annular space 154 between heater 106 and the tubing 104, but only as far as the extended retainer petal disc 142, and the alloy fills and occupies the volume above the disc 142. The relatively dense alloy displaces the well fluid from around and above the heater 106.

The alloy in closest proximity to the heater 106 will very rapidly form a melt pool, the depth of which will steadily increase as the heat from the reacting thermite travels up through the alloy. The alloy directly above the heater 106 will be heated by conduction via the bulkhead 130. As the temperature at the upper end of the heater 106 increases, the bulkhead will fluidise, and the alloy will come into direct contact with the thermite 126. Further, when the operator raises the wireline 112 the control line 136 will be lifted out of the tube 152. Once the lower end of the control line 136 clears the upper end of the tube 152, alloy 108 may flow into the tube 152. As the outer surface of the tube 152 is in direct contact with the core of the reacting thermite 126, the tube 152 will be very hot and this heat will be transferred to the alloy 108. This super-heated alloy will create a heat plume which extends upwards and into the alloy above the heater 106.

Once the thermite reaction has finished, the temperature of the thermite reaction products and the alloy will fall, such that the alloy will freeze, creating a solid plug 110 in the tubing 104, as illustrated in FIG. 2 of the drawings. The alloy will have bonded to the tubing 104 over the length of the plug, creating a secure and fluid-tight coupling.

Figure 3:
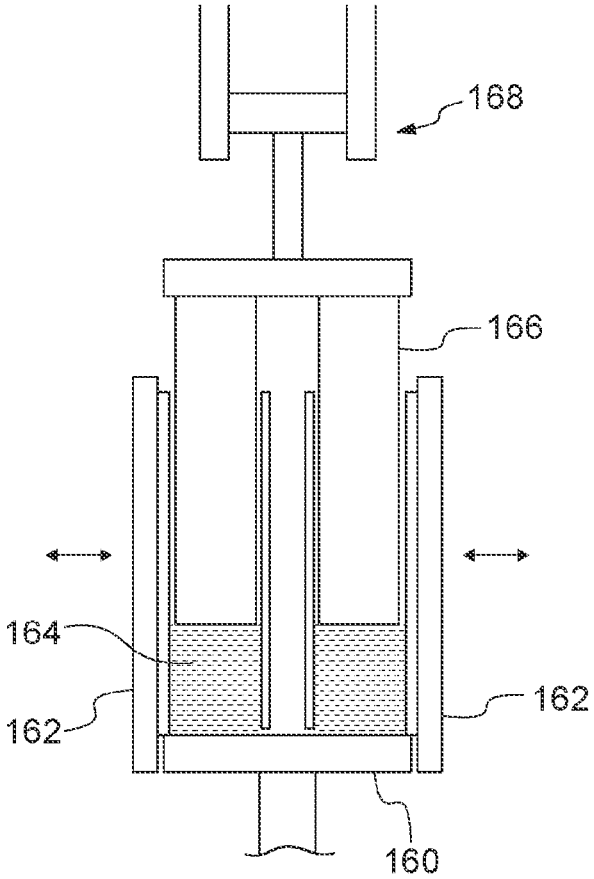
FIG. 3 is a schematic of a step in the manufacture of a heater in accordance with an example of the disclosure.

Reference is now made to FIG. 3 of the drawings, which illustrates a step in the manufacture of the heater 108. The container 128, with the tube 152 located centrally of the container 128, has been located above a supported stopper 160, and radially movable dies 162 have been positioned around and supporting the outer surface of container 128. An appropriate blend of thermite powder or particles has been made up and a first fraction of the thermite 164 is placed in the container 128. The thermite 164 may be tamped down to ensure that the powder 164 is evenly distributed. An annular punch 166, coupled to a hydraulic piston arrangement 168, is lowered into the supported container 128. The piston arrangement 168 is then energised and the punch 166 is urged into the upper surface of the thermite 164 and compresses and compacts the thermite 164.

The compression of the thermite 164 has numerous beneficial effects, including reducing the porosity of the thermite 164, increasing the density of the thermite 164, increasing the compressive strength of the thermite 164, and ensuring that the thermite 164 is in direct contact with the container 128 and the tube 152. The degree of compression may be selected by the operator, and in one example the punch applies a pressure of 10,000 psi (68.9 MPa) to the upper surface of the thermite.

The process is repeated for further fractions of thermite 164 until the container 128 has been filled to an appropriate level. The dies 162 may then be retracted to allow the filled container 128 to be removed and incorporated in the tool 100.

The provision of the dies 162 to support the container 128 allows the operator to use a container that would not necessarily withstand the pressure applied to the thermite 164 without suffering damage. For example, the container may have a relatively thin wall, reducing the mass of the container and thus the heat that will be absorbed by the container 128 when the thermite is ignited. Also, a thinner container wall may improve heat transfer and allow more effective heating of the area surrounding the heater 106. The dies also allow use of a weaker container material, such as aluminium or aluminium alloy, which may be desired to allow the thermite reaction product to fluidize and flow.

It is beneficial if the thermite 126 is kept dry and isolated from well fluids. Accordingly, the heater 106 is sealed and, at least until the thermite reaction has been initiated, the interior of the heater 106 is likely to be at atmospheric pressure. Accordingly, in the high-pressure environment of a deep well the container 128 will be subject to elevated external pressure forces. However, as the container 128 is supported internally by the thermite compacted to a powder stress in excess of the anticipated downhole pressure, the container 128 may withstand such pressures without damage or significant deformation, even if a relatively thin-walled or weak container is utilised.

The composition of the alloy 108 will be selected by the operator to suit the conditions in the well. The operator may select a bismuth-based alloy, such as bismuth/tin, which has the advantage of a relatively low melt temperature, for example 138° C. Alternatively, the operator may select a tin-based alloy, such as a Babbitt alloy, which has a higher melt temperature and better creep resistance, and less tendency to embrittle steel. In some examples a pure metal, such as Bismuth, may be preferred to an alloy. The alloy 108 is provided in combination with an appropriate flux 125, which may be useful in removing oxide from the surface of the tubing 104, protecting the surface from re-oxidation, and improving the wetting ability of the molten alloy. While previous proposals have relied upon alloys which expand on freezing to anchor the solidified alloy in a bore, testing has indicated that secure bonding may be achieved with non-expanding alloys when provided in combination with an appropriate flux.

The composition of the thermite will also be selected to suit conditions in the well and the desired characteristics and behaviour of the thermite reaction products. For example, the temperature of the thermite reaction may be controlled by selection of the thermite components and additives, and the behaviour of the thermite reaction products may be varied, for example the thermite reaction products may retain their original form or may fluidise and flow. Further, the composition of the thermite may be varied within the heater 106, or within the initiator 132, to provide different effects. In one example a portion of the thermite may be formulated to provide a high temperature and to form a relatively mobile molten iron component which may be used to severe the power cable 134 or the control line 136.

It will be apparent to the skilled person that the tool 100 offers numerous advantages and allows a secure seal to be provided in a bore 102 in a single run; the provision of the retainer 140 may obviate the requirement to set or provide a plug in the bore 102 below the sealing location. The arrangement of the tool 100, with the thermite heater 106 below the plug-forming alloy 108, and the initiation of the thermite reaction at the lower end of the thermite 126, is the optimum arrangement for heating the alloy 108. Further, the anchoring and retrieval arrangement for the power supply cable 134 and the control line 136 facilitates the thermite reaction and the heating of the alloy 108, and automatically frees the wireline 112 and the retrievable parts of the tool 100 on initiation of the thermite reaction.

It will also be apparent to the skilled person that various features of the tool 100 may have individual utility, for example features of the retainer 140 may be useful in other applications, for example as a cement plug.

A tool made in accordance with the present disclosure will of course be constructed and dimensioned according to the intended application. By way of example, a tool 100 having a running-in diameter of 3.5 inches (8.89 cm) may be used to create a seal in tubing having an internal having an internal diameter of 3.55 to 8.5 inches (9.017 to 21.59 cm). 100 to 300 kg of alloy 108 may be carried by the tool 100, and a thermite heater containing 15 to 50 kg of thermite may be provided. The alloy may be provided in the form of 1 to 5 mm diameter beads. The container 128 may be formed of steel and have a wall thickness of 2-6 mm. Such a container 128 is likely to maintain its form through the thermite reaction. Alternatively, the container 128 may be intended to melt or degrade, and for such a tool 100 an aluminium alloy with a wall thickness of 1-3 mm may be utilised. The inner tube 152 may be of any appropriate material or dimensions, for example a steel tube having an outer diameter of 15.8 mm and an inner diameter of 12.6 mm may be provided, while the control line 136 may have a diameter of ⅜ inches (3.75 mm) and the power cable 134 a diameter of 5/16 inches (1.312 mm). Such a tool 100 may be operated to provide a solid plug of alloy, that is from the upper end the heater 106 to the upper surface of the alloy, of around 1.5 m in length.

In other examples an extended inner tube may be provided to serve as the control line.

The tool 100 described above is only one example of the implementation of the teaching of the disclosure and the skilled person will realise that various modifications and improvements may be made to the tool 100 without departing from the teaching of the disclosure. For example, the tool 100 may be provided with power from surface rather than utilising a local power source, and the tool 100 may be activated by a timer, rather than sending a signal from surface.

In the illustrated example the initiator is provided towards the lower end of the heater, such that the thermite is activated bottom up, however in other examples the initiator may be provided towards the upper end of the heater, or initiators may be provided at axially spaced locations in the heater.

The relative location of elements of the tool may also be varied, for example the heater being provide above the volume of alloy, or internally of the alloy.

In the illustrated example, the heater remains in the bore and alloy may fill the annulus around the heater before forming a continuous alloy plug above the heater. However, in other examples the heater may be retrieved and lifted clear of the alloy while the alloy is in the molten state, such that the solid plug of alloy is formed directly above the retainer. Such an arrangement may provide for more efficient use of the plug-forming alloy, as the same volume of alloy may produce a greater length of solid alloy plug. The material and structure of the activated heater will not necessarily provide a fluid-tight barrier, such that the alloy that surrounds a heater which remains in the bore is not necessarily contributing to the sealing of the bore.

The invention claimed is:

1. A downhole tool comprising a heater, the heater including a container having a wall enclosing a volume of compacted thermite, the volume of compacted thermite having an external surface, wherein a substantial portion of the external surface of the volume of thermite is in contact with the container wall, and the container wall forms an external surface of the tool, and the tool further comprising a carrier containing a volume of alloy intermixed with a volume of flux, wherein the carrier is sealed to maintain the alloy and flux in a dry condition.

2. The tool of claim 1, wherein the heater includes an initiator to start the thermite reaction and the initiator is located at a lower end of the heater.

3. The tool of claim 1, wherein the thermite is sealed within the container.

4. The tool of claim 1, including a volume of alloy.

5. The tool of claim 4, wherein the alloy is initially retained within a carrier and is releasable from the carrier following ignition of the thermite.

6. The tool of claim 4, comprising flux for enhancing bonding between the alloy and a surrounding tubing.

7. The tool of claim 6, wherein the flux is provided in combination with the alloy.

8. The tool of claim 7, wherein the flux is in powder form and is mixed with alloy beads before the alloy and flux is placed in a carrier.

9. The tool of claim 1, wherein the thermite defines an internal volume, wherein a conduit extends through the internal volume, and wherein the internal volume accommodates an elongate member.

10. The tool of claim 1, further comprising a volume of alloy and a volume of flux sealed within the alloy.

11. The tool of claim 10, wherein the alloy is a cast volume, and the flux is provided within the cast volume.

12. A method of manufacturing a downhole heater, the method comprising at least partially filling a container with thermite comprising alloy and flux, compressing the thermite in the container, and enclosing and sealing the compressed thermite within the container.

13. The method of claim 12, wherein a first fraction of the volume of thermite is placed in the container and then subject to compression, and a second fraction of the volume of thermite is placed in the container over the first fraction, and then subject to compression.

14. The method of claim 12, wherein a wall of the container is supported as the thermite is compressed in the container.

15. The method of claim 14, wherein the container is located within a supporting die.

16. The method of claim 12, wherein a wall defining an internal volume is supported while the thermite is compacted in the container.

17. The method of claim 12, further comprising compacting powdered or granular thermite and at least one of: reducing the volume of the thermite by more than a factor of two; reducing the porosity of the thermite to 35% or less, and increasing its density proportionally to a specific gravity of at least 2.7.

18. The method of claim 12, wherein the heater is adapted for location in a downhole tool intended to experience a predetermined downhole pressure, and further comprising compacting the thermite to a powder stress in excess of said downhole pressure.

19. A downhole tool comprising:

a heater including a container enclosing a volume of compacted thermite; and a volume of alloy and flux provided within a sealed carrier such that the alloy and flux remain dry as the alloy and flux are run into a fluid-filled bore.

* * * * *